US006632263B1

(12) United States Patent
Nigarura et al.

(10) Patent No.: US 6,632,263 B1
(45) Date of Patent: Oct. 14, 2003

(54) SINTERED PRODUCTS HAVING GOOD MACHINEABILITY AND WEAR CHARACTERISTICS

(75) Inventors: Salvator Nigarura, Huber Heights, OH (US); Mark Birler, Ann Arbor, MI (US); Juan Trasorras, Ann Arbor, MI (US)

(73) Assignee: Federal - Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 10/138,229

(22) Filed: May 1, 2002

(51) Int. Cl.[7] ..... C22C 33/02; B22F 3/14

(52) U.S. Cl. ..... 75/231; 75/243; 75/246; 419/10; 419/11; 419/48

(58) Field of Search ..... 75/231, 243, 246; 419/10, 11, 48

(56) References Cited

U.S. PATENT DOCUMENTS

| | | | |
|---|---|---|---|
| 2,671,726 A | 3/1954 | Jennings | |
| 3,856,478 A | 12/1974 | Iwata et al. | |
| 3,925,062 A | 12/1975 | Trombe et al. | |
| 4,122,817 A | 10/1978 | Matlock | |
| 4,344,795 A | 8/1982 | Endo et al. | |
| 4,422,875 A | 12/1983 | Nakata et al. | |
| 4,546,737 A | 10/1985 | Kazuoka et al. | |
| 4,583,502 A | 4/1986 | Takahashi et al. | |
| 4,632,074 A | 12/1986 | Takahashi et al. | |
| 4,671,491 A | 6/1987 | Kuroishi et al. | |
| 5,041,158 A | 8/1991 | Larson | |
| 5,239,951 A | 8/1993 | Rao et al. | |
| 5,259,860 A | 11/1993 | Ikenoue et al. | |
| 5,295,461 A | 3/1994 | Rao et al. | |
| 5,406,917 A | 4/1995 | Rao et al. | |
| 5,431,136 A | 7/1995 | Kenmoku et al. | |
| 5,495,837 A | 3/1996 | Mitsuhashi et al. | |
| 5,507,257 A | 4/1996 | Sakai et al. | |
| 5,655,493 A | 8/1997 | Enright et al. | |
| 5,674,449 A | 10/1997 | Liang et al. | |
| 5,703,304 A | 12/1997 | Lindberg et al. | |
| 5,870,989 A | 2/1999 | Takahashi et al. | |
| 5,904,125 A | 5/1999 | Enright et al. | |
| 5,934,236 A | 8/1999 | Rao et al. | |
| 5,975,039 A | 11/1999 | Oshige | |
| 6,228,138 B1 * | 5/2001 | Yamanishi et al. | 75/231 |

* cited by examiner

*Primary Examiner*—Ngoclan Mai
(74) *Attorney, Agent, or Firm*—Howard & Howard

(57) ABSTRACT

An iron-based sintered powder metal mixture for valve guides, valve seat inserts and other high temperature, high wear applications requiring excellent net-shape stability during sintering comprises a powder metal mixture consisting essentially of 0.5–2.0 wt. % of fine, soluble graphite which goes into solution in the elemental iron matrix, 0.5–2.5 wt. % stable graphite which remains as free graphite in the sintered structure, 0.5–3.0 $MoS_2$, which reacts with 1.0–5.0 wt. % copper to drive a sintering reaction at relatively low sintering temperatures of between 1030—1150° C. The resulting sintered particles have good mechanical strength and wear resistance and possess excellent machineability and dimensional stability.

9 Claims, 3 Drawing Sheets

SINTERED PRODUCTS HAVING GOOD MACHINEABILITY AND WEAR CHARACTERISTICS

BACKGROUND OF THE INVENTION

1. Technical Field

This invention relates generally to the art of powder metallurgy, and more particularly to iron-based products such as valve guides and valve seat inserts.

2. Related Art

Powder metal valve guides, valve seat inserts and other high temperature wear components are often manufactured from iron-based powder mixtures or pre-alloy powders. In the case of mixtures, various powder additives are combined with elemental iron powder to provide lubricity, wear resistance, machineability and high temperature strength. One common additive employed as a solid lubricant is molybdenum disulfide ($MOS_2$). $MoS_2$ has a double layered structure of sulfur held together by weak Van-der-Waals forces which shear under pressure to provide good lubrication at levels of about 2–3 wt. % of the mixture. While $MoS_2$ is an excellent solid lubricant, it has a tendency to expand during sintering when present in amounts normally used for solid lubricant, particularly when present in a mixture containing carbon and copper. The high distortion associated with $MoS_2$ (as much as 1% or more change in dimension from compaction to sintering) is detrimental to the manufacture of low cost, high precision net shape articles such as valve guides and valve seat inserts, and thus $MoS_2$ as a lubricant is typically avoided in such powder metal applications.

U.S. Pat. No. 5,507,257 discloses an iron-based powder metal mixture for valve guide applications which contains additions of coarse and fine graphite powder together with the addition of ferrophosphorus or cuprophosphorus powders. The resultant sintered articles contain hard Fe—C—P dispersions in the iron matrix together with a certain amount of free graphite from the coarse graphite powder. The patent further reports the formation of carbides when the mixture contains molybdenum powder. Phosphorus is known in the art to have a stabilizing effect on the α-iron. Low carbon solubility in the α-iron phase promotes the presence of free graphite in the sintered article which is beneficial as a solid lubricant. In addition, phosphorus is known to accelerate sintering through formation of a transient liquid phase. While phosphorus stabilizes the α-iron phase and promotes sinterability, it is also detrimental in that the partial liquid phase sintering causes shrinkage upon solidification to such a degree that the tolerances of sintered products for net-shape applications may be adversely affected At high carbon contents greater than 0.2 wt. %, hard phosphorus compounds and cementite form at the grain boundaries as a result of the partial liquid phase sintering and are detrimental to Vie machineability of the parts. For at least these reasons, the addition of phosphorus in iron-based net-shape powder metal applications is generally undesirable for its detrimental effect on net-shape stabilization and machineability.

SUMMARY OF THE INVENTION AND ADVANTAGES

Iron-based sintered powder metal articles according to the invention are fabricated from an iron-based powder metal mixture consisting essentially of, by weight: 0.5–2.5% stable graphite having a mesh size of about 325 to 100, 0.5–2.5% soluble graphite having a mesh size greater than 325, 0.5–3.0% $MoS_2$, 1.0–5.0% Cu, and the balance to Fe and impurities.

$MoS_2$, when combined with carbon and copper in an iron-based system has shown to react favorably with carbon and copper to promote sinterability even at low temperatures of between 1030–1150° C. while achieving good levels of material strength which are normally attained at higher sintering temperatures. The reaction during sintering is advantageously a solid state reaction, avoiding the formation of a transient liquid phase which occurs for example, with the addition of phosphorus, known to be detrimental to dimensional stability of net-shaped articles such as valve guides and valve seat inserts. The relatively low $MoS_2$ additions work in sinergy with the additions of stable and soluble graphite to achieve the desired properties of good strength, wear resistance and machineability. The additions of the relatively fine soluble graphite reacts sacrificially with the elemental iron powder during sintering in a solid state reaction to retain coarse graphite. The relatively coarse stable graphite is, effectively, insoluble in the iron and it is present in the sintered article as free graphite to promote good machineability of the sintered article. The combined carbon promotes good strength and wear resistance.

A significant cost saving is realized by sintering the articles at 20 relatively low sintering temperatures of 1030–1150° C., and particularly at about 1050° C. Added strength and wear resistance can be attained when sintering the articles at the higher end of the sintering range (i.e., toward 1150° C.), wherein the $MoS_2$ reacts to form molybdenum carbides, while the stable graphite retains the presence of free graphite in the sintered structure for achieving good machineability. Thus, the powder metal mixture according to the invention enables articles to be compacted and sintered at relatively low sintering temperatures as compared to conventional sintering temperatures for iron-based powders having similar properties, while achieving high strength and wear resistance with or without the formation of molybdenum carbides while attaining excellent machineability and dimensional stability of the sintered structure.

The invention also contemplates a method of forming sintered articles, wherein an iron-based powder mixture is prepared according to the above composition and then is compacted and sintered at temperatures between 1030–1150° C. to achieve a high strength, high wear resistant article having the characteristics of good machineability and excellent dimensional stability for net-shape, high temperature wear applications.

THE DRAWINGS

These and other features and advantages of the present invention will become more readily appreciated when considered in connection with the following detailed description and appended drawings, wherein.

DETAILED DESCRIPTION

Figure 1:
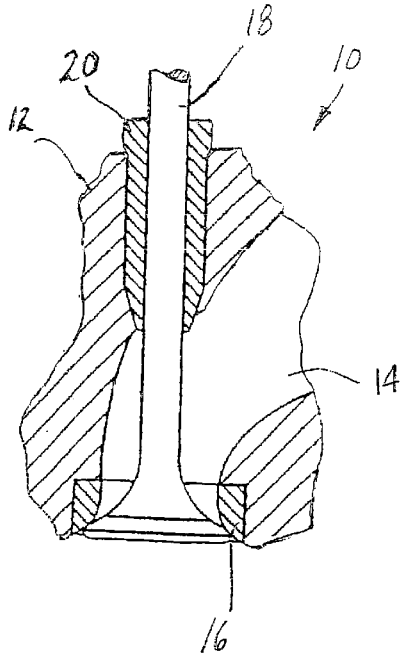
FIG. 1 is an enlarged fragmentary sectional view of an engine having a valve guide and valve seat insert constructed according to the invention.

Referring initially to FIG. 1, an internal combustion engine is shown at 10 having a cylinder head 12 formed with an exhaust or intake passage 14 in which a valve seat insert 16 is disposed. A valve 18 communicates with the valve seat insert 16 and is guided in a valve passage by a valve guide 20 disposed therein.

According to the invention, the valve seat insert 16 and/or the valve guide 20 for use in internal combustion engine applications is constructed from a sintered powder metal composition. The composition exhibits sufficient strength and wear resistance for use in high temperature, wear applications such as the valve seat insert 16 and valve guide 20 above, and is best suited for valve intake applications, although not limited thereto.

In addition to the strength and wear resistance properties, the sintered powder metal composition according to the invention possesses excellent dimensional stability, good machineability, and the ability to be processed at relatively low sintering temperatures, which is advantageous from both a manufacturing and performance point of view.

In addition to valve guides and valve seat inserts, the material and process according to the invention has application to other components where the properties of good strength, wear resistance, machineability and dimensional stability in an iron-based powder metal system are desired. Accordingly, while the description is directed to valve guides and valve seat inserts (collectively valve wear components) it will be appreciated that the invention is applicable to and contemplates application to other components having same or similar properties.

According to a first presently preferred embodiment of the invention, sintered iron-based powder metal valve wear components, such as the valve seat insert 16 and/or valve guide 20, are fabricated from an iron-based powder metal mix consisting essentially of 0.5–2.5 wt. % stable graphite having a U.S. Standard sieve designation of about 325 100 mesh, 0.5–2.0 wt. % soluble graphite having a U.S. Standard Sieve designation of greater than 325 mesh, 0.5–3.0 wt. % $MOS_2$, 1.0–5.0 wt. % Cu, and the balance Fe and impurities. The iron-based powder metal mixture is compacted to the desired net-shape size of the article and then sintered at a relatively low sintering temperature of between 1030° C. (1886° F.) to 1150° C. (2102° F.) to achieve a sintered structure having excellent wear resistance, machineability, and dimensional stability as will be explained below with reference to the examples given. The base fe powder may comprise pre-alloyed iron powder containing about 0.5 to 3.0% molybdenum, 0 to 0–3% nickel, 0 to 3.0% chromium and 0 to 3.0% mangenese.

It is an object of the present invention to provide a process and resultant powder metal articles fabricated of free graphite-containing iron-based alloys by combining additions of stable and soluble graphite combined with $MoS_2$ and Cu, wherein the soluble carbon goes into solution with the iron to provide high strength while preserving the free graphite during sintering to provide good machineability, and wherein a solid state reaction occurs between $MoS_2$ and Cu as a driving force for sintering at low temperatures without sacrificing material strength. The absence of a liquid phase during sintering and control of the $MoS_2$, which is kept sufficiently low so as not to be present in such an amount as to cause unwanted dimensional changes during sintering, enable a very tight control of part dimensions through sintering to be maintained (with changes in dimension from compaction to sintering being less than 1%).

The specified additions to the iron-based powder mixture mentioned above are present in the mix and limited by the compositional ranges given for the following reasons:

Soluble graphite 0.5–2.0 wt. %. The soluble carbon is provided as a relatively fine graphite or carbon powder which is readily soluble in the elemental iron powder matrix. The sieve size of the fine, soluble graphite powder is set at greater than 325 mesh, such that the particles have an effective diameter of 44 $\mu$m or less. Preferably, about 90% of the soluble graphite is below 20 $\mu$ms and 50% is below 10 $\mu$ms. The fine, soluble graphite acts in a significant capacity during sintering to go into solution in the elemental iron matrix in a controlled manner to achieve the desired strength of the matrix, while preserving the less soluble and comparatively inert stable graphite, described below, which is preserved during sintering and results in the formation of free graphite in the sintered structure. If the soluble carbon content is below the specified range, the ability to quickly diffuse enough carbon into iron at the specified low sintering temperatures (particularly at 1050 C) is impaired to the point where the desired mechanical strength is not achieved. Also, a soluble carbon content below the specified range does not provide adequate sacrificial protection to the stable graphite such that the desired extent of the free graphite in the sintered product is not attained which greatly impairs the machineability of the sintered article. If the soluble carbon content exceeds the specified range, then excessive carbide formation occurs which also impair machineability.

Stable graphite: 0.5–2.5 wt. %. The stable graphite is provided in such a quantity and particle size that it is retained in the sintered structure as free graphite to promote free machining of the sintered article. The mesh size of the stable graphite is set at 325 100, which corresponds to particle diameters in the range of 44–150 $\mu$m with 60% being between 75 and 150 $\mu$ms. Graphite finer than the specified range will not be retained as free graphite, but will go into solution in the iron, and graphite having a particle size greater than that specified decrease the material strength of the sintered material. The presence of the relatively coarse, stable graphite in the mixture enables the content of $MoS_2$ to be decreased below a range where $MoS_2$ presents problems with dimensional control, while still present at a level where $MoS_2$ can contribute to machineability and enhanced sintering as described below. Unlike $Mos_2$, the stable graphite does not change structure during sintering and thus is dimensionally stable during sintering to promote retention of the net-shape dimensions of the compacted material through sintering. In the specified sintering range, the dimensional change as a result of sintering as compared to the dimension following compaction is less than 1%, and as low as 0.5%.

$MoS_2$: 0.5–3.0 wt. %. The $MoS_2$ is present in the mixture in the quantity specified for its ability to react with copper during sintering to promote sinterability at low sintering temperatures. While the exact mechanism of the reaction is not entirely understood, the studies with and without additions of $MoS_2$ with copper in the iron-based system which additionally include the soluble and stable carbon have shown to react favorably in a way which achieves rapid sintering at low sintering temperatures (as low as 1030° C.) to achieve the desired machineability and dimensional control of the sintered material without sacrificing material strength and wear resistance. At low sintering temperatures, the $MoS_2$ combines with copper in solid state reaction to achieve rapid sintering at the specified low temperatures. At high temperatures of 1150° C. and above, the $MoS_2$ dissociates and forms molybdenum carbides for even greater material strength and wear resistance, without sacrificing the dimensional stability and machineability. Thus, the desired material strength and wear resistance properties can be adjusted through selection of the sintering temperature without having to change the alloy and without sacrificing the desired dimensional stability and machineability characteristics. If $MoS_2$ is present in the mix above the specified range, it is detrimental to the dimensional stability of the sintered material. If the $MoS_2$ content is below the specified range, the beneficial effects of the reaction with copper to achieve accelerated sintering at the low temperatures is not recognized, and the hardness and strength of the sintered material are negatively affected.

Copper: 1.0–5.0 wt. %. Copper, as mentioned above, reacts favorably with the $MoS_2$ as a driving force for sintering at the specified low temperatures. If the copper content is below the specified range, the enhanced sinterability cannot be recognized to the desired extent, and if above the specified range, is prone to embrittlement of the sintered structure.

EXAMPLE 1

In a first example, a powder metal mixture was prepared using the following starting powders:

Stable graphite powder particle size: 325–100 mesh;

Soluble graphite powder, particle size: −325 mesh;

$MoS_2$, particle size: −325 mesh;

Cu powder, particle size: −325 mesh;

Atomized Fe powder and/or sponge Fe powder, particle size: −100 mesh.

The mixture of Example 1 consisted essentially of 1.0 wt. % stable graphite powder, 0.5 wt. % soluble graphite powder, 1.0 wt. % $MoS_2$, 2.0 wt. % copper powder and the balance iron powder and unavoidable impurities.

The powder mixture of Example 1 was compacted into a valve guide at a nominal density of 6.7–6.8 g/cm$^3$, and sintered in a conventional mesh belt furnace in a mixture of $N_2$—$H_2$ atmosphere at 1030° C. After sintering, dimensional changes versus die size were determined. Finished ground valve guides were used to measure hardness and to determine compression strength in a direct loading of the valve guide between two platens of a servo-hydraulic tension/compression testings machine. Standard transverse rupture strength samples were made and sintered at the same time with the valve guides to evaluate the material resistance in a standard three-point bending test. Machineability was evaluated by reaming the bore of numerous valve guide samples and measuring the wear of the reamer tool used to machine the samples. The machineability results were compared to existing results obtained on a non-free graphite containing mixture (reference sample). Hot wear resistance was evaluated using a linearly reciprocating Al2O3 ball on a flat sliding wear sample according to ASTM G 133–95 at a fixed sample temperature of 200° C. Mounts of the sintered valve guides were prepared and evaluated for microstructure.

Figure 2:
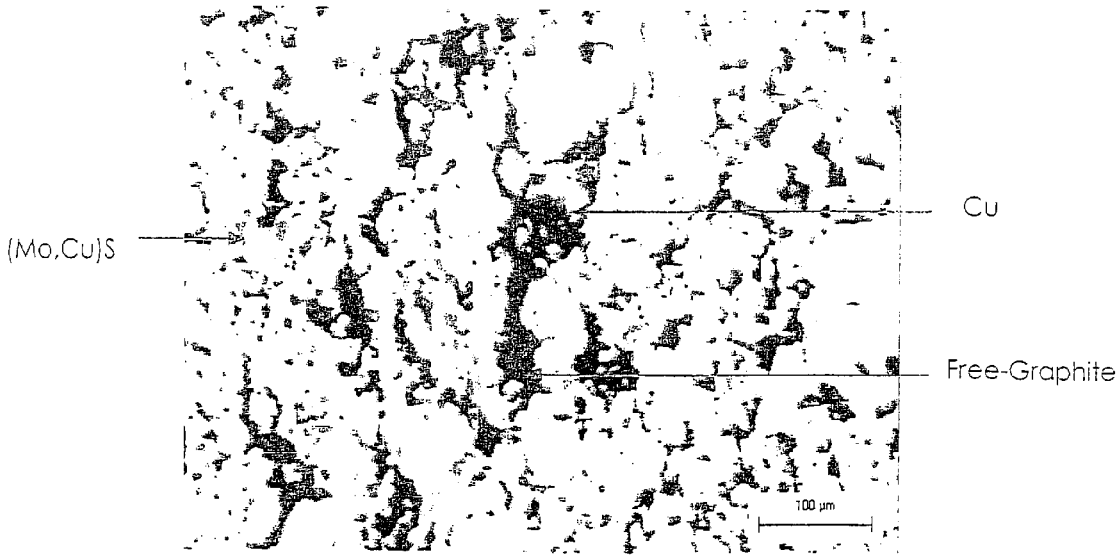
FIG. 2 is a photomicrograph of the iron-based powder metal material according to a presently preferred embodiment of the invention which has been compacted and sintered at 1050° C.
Figure 3:
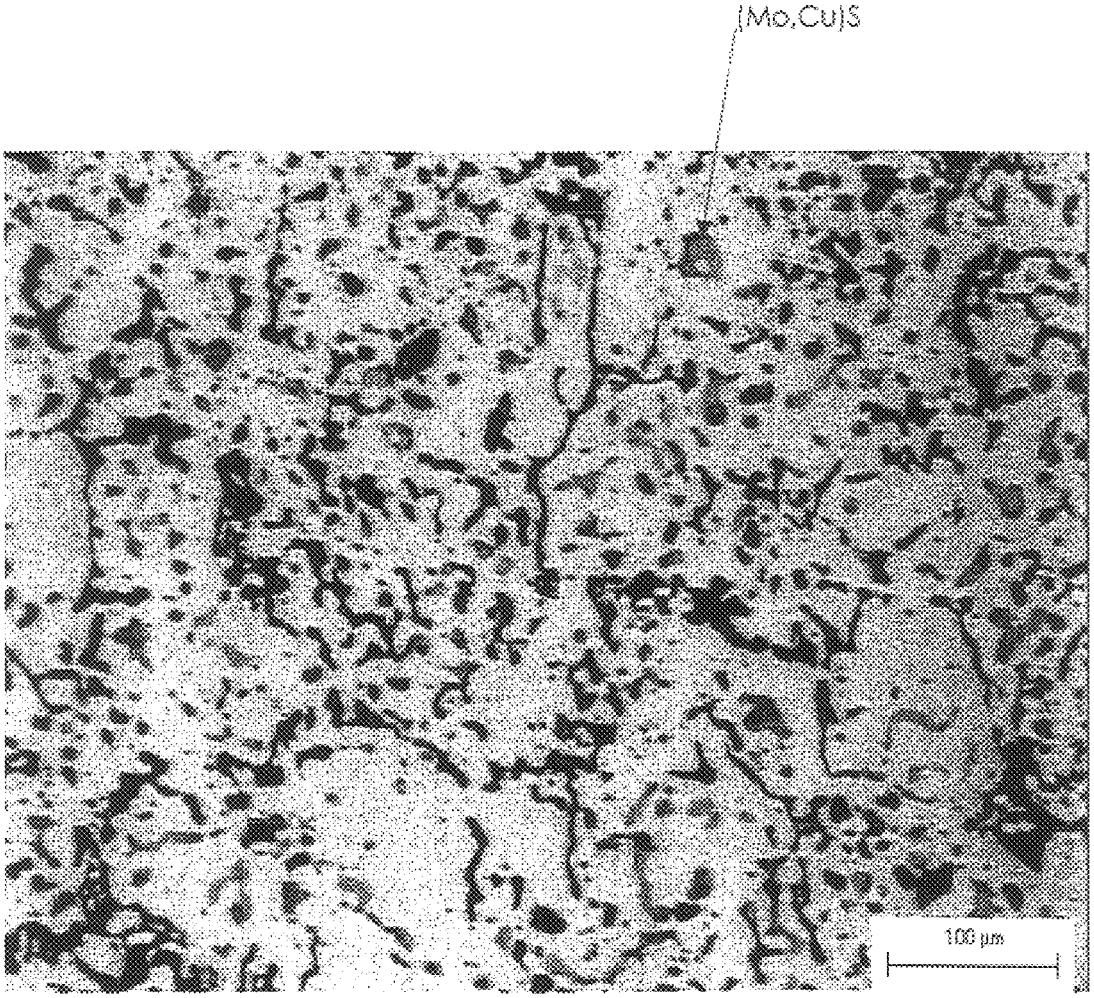
FIG. 3 is a photomicrograph shown for purposes of comparison, of the subject mixture without the addition of free graphite and sintered at 1050° C.

Results of the above investigations are presented in Table 1. A representative microstructure of Example 1 showing the presence of free graphite and few undissolved copper particles is shown in FIG. 2, whereas the microstructure of the reference material is shown in FIG. 3.

EXAMPLE 2

Figure 4:
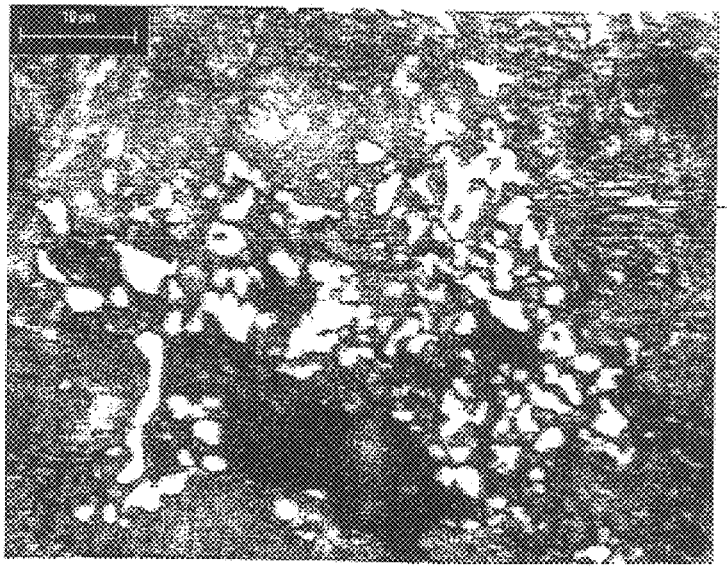
FIG. 4 is a photomicrograph of the same material of FIG. 2 sintered

Example 2 repeated Example 1 except that sintering of compacted valve guides was carried out at a higher sintering temperature of 1150° C. The representative microstructure of the subject powder metal mix sintered at the higher temperature of 1150° (FIG. 4) shows the formation of Mo-based carbides formed inside former $MoS_2$ particles which are present at the lower sintering temperature as shown by the microstructure of FIG. 2.

Example 3 was prepared according to an alternative embodiment of the invention. The same starting powder mixture was used except for the omission of $MoS_2$ and had the following composition: 1.5 wt. % stable graphite powder, 1.0 wt. % soluble graphite powder, 2.0 wt. % copper powder, and the balance iron powder and unavoidable impurities.

Figure 5:
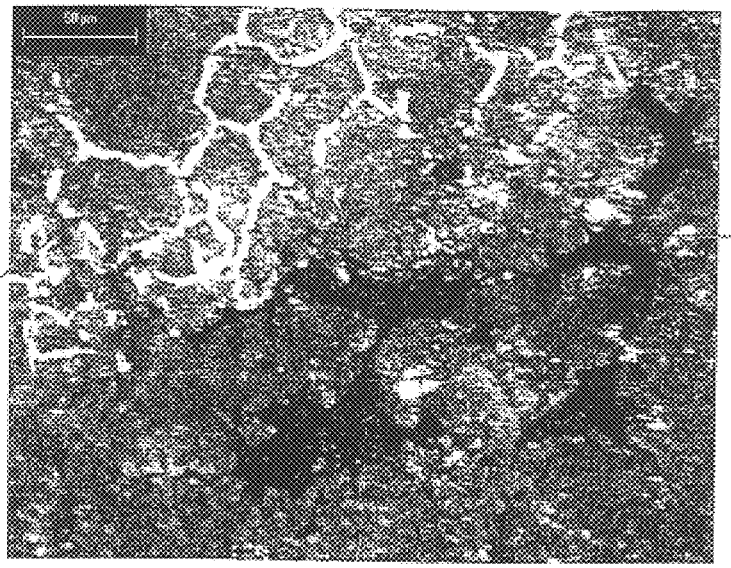
FIG. 5 is a photomicrograph of an alternative powder mix composition according to the invention shown sintered at 1150° C.

Example 3 repeated Example 2, with sintering being carried out at 1150° C. The results of testing are shown in Table 1. A representative microstructure of the sintered material of Example 3 is shown in FIG. 5, there a network of grain boundary cementite is present together with free graphite. It will be seen from Table 1 that the hardness and material strength of Example 3 is increased over the Example 1 material, but is still more dimensionally stable than that of the high temperature reference material with satisfactory machineability, although not as stable as the alloy mixture of Example 2 containing $MoS_2$.

TABLE 1

| Characterization Results | | | | | | |
|---|---|---|---|---|---|---|
| Alloy Ident. | Hardness; (HRB) | Dimensional Change Vs Die Size (%) | TRS (ksi) | Wear Resistance Wear Scar Vol. ($mm^3$) | Comp. Strength (Lbf to failure) | Machineability Average Reamer Wear ($\mu m$) |
| Reference Material-Low Temperature Sintered | 73 | +1.0 | 93 | 0.93 | >14000 | 7.5 |
| Reference Material-High Temperature Sintered | 88 | +1.3 | 93 | 0.75 | >14000 | 159 |
| Alloy A-Low Temperature Sintered (Example 1) | 72 | +0.5 | 88 | 0.73 | >14000 | 5.0 |
| Alloy A-High Temperature Sintered (Example 2) | 85 | +0.80 | 98 | 0.80 | >14000 | 155 |
| Alloy B-High Temperature Sintered (Example 3) | 85 | +0.3 | 93 | 0.54 | >14000 | 85 |

Obviously, many modifications and variations of the present invention are possible in light of the above teachings. It is, therefore, to be understood that within the scope of the appended claims, the invention may be practiced otherwise than as specifically described. The invention is defined by the claims.

What is claimed is:

1. A Fe-based sintered powder metal article fabricated from an iron-based powder metal mixture material consisting essentially of, by weight: 0.5–2.5% stable graphite having a U.S. Standard sieve designation of about 325 to 100 mesh, 0.5 to 2.0% soluble graphite having a U.S. Standard sieve designation of >325 mesh, 0.5 to 3.0% $MoS_2$, 1.0 to 5.0% Cu, and the balance Fe and impurities.

2. A powder metal article as claimed in claim 1 wherein the base iron powder is a pre-alloyed iron powder containing about 0.5 to 3.0% molybdenum (Mo); 0 to 3% nickel; 0 to 3% Cr and 0 to 3% Mn.

3. The sintered powder metal article of claim 1 wherein said powder metal mixture is compacted and sintered at a temperature of between about 1050° and 1150° C.

4. The sintered powder metal article of claim 1 wherein said powder metal mixture is compacted and sintered at a temperature of about 1050° C.

5. The sintered powder metal article of claim 1 wherein said powder metal mixture is compacted and sintered at a temperature of about 1150° C.

6. The sintered powder metal article of claim 1 wherein said article comprises a valve guide or valve seat insert of an engine.

7. The sintered powder metal article of claim 1 wherein the mixture is free of phosphorus.

8. A Fe-based sintered powder metal valve guide for an engine fabricated from a phosphorus-free powder metal mixture consisting essentially of, by weight: 0.5–2.5 stable graphite having a mesh size of about 325–100; 0.5–2.0 soluble graphite having a mesh size of >325; 1.0 to 5.0% Cu; and the balance Fe and impurities, said mixture being compacted and sintered at a temperature of about 1150° C.

9. A method of making Fe-based sintered powder metal articles having good wear resistance and machineability, said method comprising the steps of:

preparing a powder metal mixture consisting essentially of, by weight: 0.5–2.5% stable graphite having a U.S. Standard sieve designation of about 325 to 100 mesh, 0.5 to 2.0% soluble graphite having a U.S. Standard sieve designation of >325 mesh, 0.5 to 3.0% $MoS_{2,\ 1.0}$ to 5.0% Cu, and the balance Fe aid impurities;

compacting and sintering the mixture at a temperature between 1030 and 1150° C. to develop a transverse rupture strength of between about 85 to 100 Ksi and a growth rate of less than 1%.

* * * * *

UNITED STATES PATENT AND TRADEMARK OFFICE

CERTIFICATE OF CORRECTION

PATENT NO. : 6,632,263 B1 
DATED : October 14, 2003
INVENTOR(S) : Salvator Nigarura, Mark Birler and Juan Trasorras It is certified that error appears in the above-identified patent and that said Letters Patent is hereby corrected as shown below:

Column 8,
Line 44, please delete subscript "$_{1.0}$" and insert therein -- 1.0 --
Line 45, after "balance Fe", please delete "aid" and insert therein -- and --

Signed and Sealed this

Twentieth Day of January, 2004

JON W. DUDAS
*Acting Director of the United States Patent and Trademark Office*